United States Patent [19]

Low

[11] Patent Number: 4,708,788

[45] Date of Patent: Nov. 24, 1987

[54] UPGRADING CARBONACEOUS MATERIALS

[75] Inventor: Jim Y. Low, Bartlesville, Okla.

[73] Assignee: Phillips Petroleum Company, Bartlesville, Okla.

[21] Appl. No.: 631,366

[22] Filed: Jul. 16, 1984

[51] Int. Cl.[4] ..... C10G 1/06; C10G 47/00; C10G 47/02

[52] U.S. Cl. ..... 208/390; 208/408; 208/422; 208/107; 208/112

[58] Field of Search ..... 208/8 LE, 10, 11 LE, 208/107, 112

[56] References Cited

U.S. PATENT DOCUMENTS

| | | | |
|---|---|---|---|
| 2,953,513 | 9/1960 | Langer, Jr. | 208/56 |
| 3,252,895 | 5/1966 | Gleim et al. | 208/264 |
| 4,045,328 | 8/1977 | Green et al. | 208/8 |
| 4,081,359 | 3/1978 | Gatsis et al. | 208/8 LE |
| 4,097,361 | 6/1978 | Ashworth | 208/10 |
| 4,115,246 | 9/1978 | Sweany | 208/56 |
| 4,179,352 | 12/1979 | Effron | 208/8 LE |
| 4,206,033 | 6/1980 | Neavel et al. | 208/10 X |
| 4,210,518 | 7/1980 | Wilson, Jr. et al. | 208/10 |
| 4,324,644 | 4/1982 | Durai-Swamy | 208/8 LE |
| 4,328,088 | 5/1982 | Anderson et al. | 208/8 LE |
| 4,332,667 | 6/1982 | Epperly et al. | 208/8 LE |
| 4,379,744 | 4/1983 | Rosenthal et al. | 208/8 LE X |
| 4,400,263 | 8/1983 | Kydd et al. | 208/10 |
| 4,434,045 | 2/1984 | Vernon et al. | 208/107 |
| 4,440,622 | 4/1984 | Derbyshire et al. | 208/8 LE |

*Primary Examiner*—Andrew Metz
*Assistant Examiner*—William G. Wright
*Attorney, Agent, or Firm*—Williams, Phillips & Umphlett

[57] ABSTRACT

A liquefaction process for coal lignite or heavy oil is disclosed utilizing a hydrogen-donor solvent. The preferred hydrogen-donor solvent is recovered as a vapor from the liquefaction mixture. The preferred method for converting the vapor into active hydrogen-donor solvent form involves passage of the vapor over a catalyst bed positioned in the vapor space of the catalyst vessel. Novel apparatus for so positioning the catalyst bed is also disclosed.

12 Claims, 7 Drawing Figures

UPGRADING CARBONACEOUS MATERIALS

BACKGROUND OF THE INVENTION

In certain aspects, the invention relates to the liquefaction and/or gasification of carbonaceous materials. In other aspects, the invention relates to an improved upgrading process for carbonaceous materials utilizing a hydrogen-donor solvent. In yet another aspect, the invention relates to an apparatus for conducting liquefaction reactions with hydrogen-donor solvent.

Normally solid carbonaceous materials having a high carbon-to-hydrogen ratio can be upgraded by the addition of hydrogen. Conducting the process under conditions of elevated temperature and pressure promotes the yield of desired products, usually liquids. One such upgrading process centers around the use of a hydrogen-donor solvent in a liquefaction zone. Preferably a portion of the liquefaction product is hydrogenated and recycled to the liquefaction zone to serve as hydrogen-donor solvent.

It is economical in such processes to cycle the hydrogen-donor solvent because the liquefaction zone and the solvent hydrogenation zone. Processes for expeditiously providing recycled hydrogenated hydrogen-donor solvent are very desirable.

OBJECTS OF THE INVENTION

It is an object of this invention to provide an upgrading process in which hydrogen is added to carbonaceous material.

It is a further object of this invention to provide a liquefaction process utilizing a hydrogen-donor solvent to supply at least a portion of the upgrading hydrogen.

It is yet another object of this invention to provide a liquefaction process using simple and effective circulation of the hydrogen-donor solvent.

Another object of the invention is to provide an apparatus for carrying out the liquefaction of carbonaceous materials.

SUMMARY OF THE INVENTION

In one aspect of the invention, there is provided a process for obtaining liquids from normally solid carbonaceous material. The carbonaceous material is formed into a reaction mixture with hydrogenated hydrogen-donor solvent and hydrogen and maintained under conditions of elevated temperature and pressure sufficient for upgrading to occur. The normally liquid reaction mixture equilibrates with a vapor phase portion of the upgraded carbonaceous material and a liquid phase portion of the upgraded carbonaceous material. The vapor phase can be separated from the liquid phase and hydrogenated to serve as a hydrogen-donor solvent by passing at least a portion of it directly through a regeneration zone without further purification. In the regeneration zone, conditions are such so as to convert at least a portion of the vapor into hydrogenated hydrogen-donor solvent. The thus formed hydrogen-donor solvent can then be introduced into the liquefaction zone to promote the upgrading occurring therein. By using this process, the feed for the regeneration zone for forming the hydrogen-donor solvent comprises a portion of the gaseous effluent from the liquefaction process.

In another aspect, an apparatus is provided for carrying out a liquefaction process. The apparatus comprises a first vessel which is suitable for use with internal pressure in the range of from 300 to 3000 psig. A mechanical agitator is positioned in a lower portion of the inside of the first vessel. A drive means is coupled to the mechanical agitator so as to cause fluid circulation in the lower portion of the first vessel due to the action of the mechanical agitator. The apparatus is further provided with a means for supporting a catalyst bed. So that the catalyst bed can be used to hydrogenate a portion of the process vapor, there is provided a means for causing fluid flow from an upper portion of the first vessel, through the means for supporting a catalyst bed, and into the lower portion of the first vessel.

DETAILED DESCRIPTION OF THE INVENTION

Figure 1:
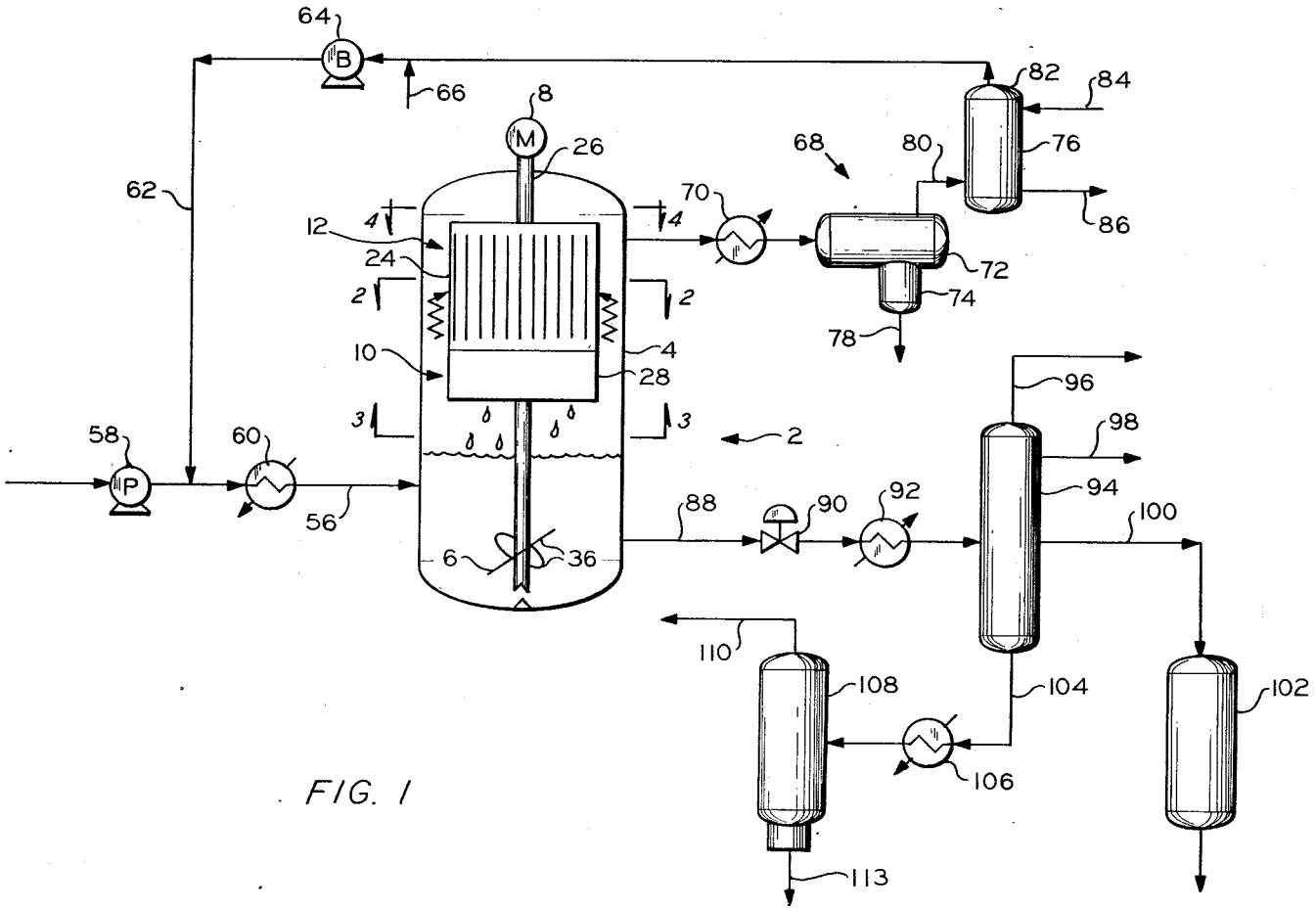
FIG. 1 illustrates schematically certain features of an embodiment of the invention.
Figure 2:
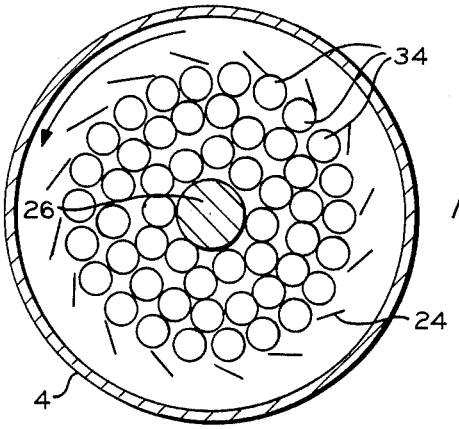
FIG. 2 is a cross-sectional view of the apparatus of FIG. 1 when viewed along lines 2—2.
Figure 3:
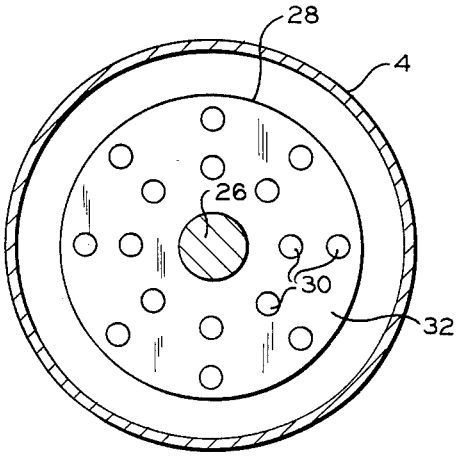
FIG. 3 is a view of a portion of the apparatus of FIG. 1 when viewed along lines 3—3.

With reference to FIGS. 1 through 3, an apparatus 2 for carrying out a liquefaction process comprising a pressure vessel 4 which is suitable for use with internal pressures in the range of from about 300 to about 3000 psig. A mechanical agitator 6, such as a propeller or paddles, is positioned on the inside of the vessel 4 in a lower portion of the vessel 4. A drive means 8 is coupled to the mechanical agitator 6 or causing fluid circulation in the lower portion of the first vessel 4 due to the action of the mechanical agitator 6. A means 10 is provided in operable association with the vessel 4 for supporting a catalyst bed. A means 12 is provided for causing fluid flow from an upper portion of the first vessel 4 through the means 10 for supporting the catalyst bed and preferably back into a lower portion of the first vessel 4. Corresponding features of FIG. 7 are pointed out with the same reference numerals.

Figure 7:
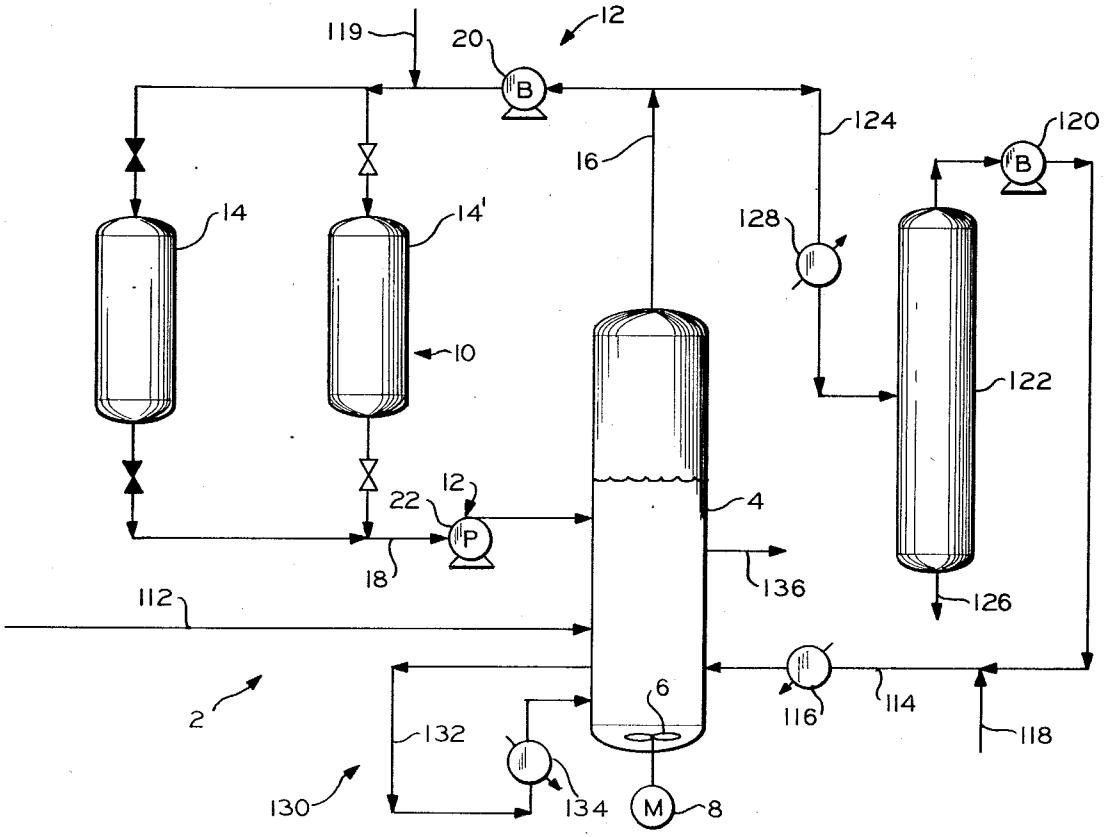
FIG. 7 schematically illustrates certain features according to another embodiment of the invention.

In the apparatus shown in FIG. 7, the means 10 for supporting the catalyst bed co mprises at least one second vessel 14 or 14' located apart from the first vessel 4. The means 12 for causing fluid flow comprises a first conduit 16 connecting an upper portion of the first vessel 4 to the second vessel 14 and a second conduit 18 connecting the second vessel 14 and the first vessel 4. In one embodiment, a pair of second vessels 14 and 14' are positioned apart from the vessel 4 and the conduits 16 and 18 are valved so that the beds contained in the vessels 14 and 14' can be alternately regenerated within interruption of the liquefaction process. A blower 20 can be positioned in the conduit 16 to cause fluid flow through the catalyst beds contained in the vessels 14 and 14'. A pump 22 can be positioned in the conduit 18 to assist liquid flow from the catalyst beds contained in the vessels 14 and 14' to a lower portion of the vessel 4.

With reference to FIG. 1, the means 10 for supporting the catalyst bed is positioned in an upper portion of the vessel 4. In the illustrated embodiment, the means 12 for causing fluid flow from an upper portion of the vessel 4 through the means 10 for supporting the catalyst bed comprises a fan, such as a squirrel cage blower 24 positioned in an upper portion of the vessel 4 and a basket 28 positioned beneath the fan, said basket having apertures 30 at least through the bottom end 32 of the basket. The basket is provided to contain particles 34 of a suitable hydrogenation catalyst, preferably in the shape of a generally cylindrical extrudate. The apertures 30 are positioned to provide for liquid drainage from the lower end 32 of the basket. The fan 24 and the basket 28 are preferably mounted on a shaft 26 positioned in the vessel. The mechanical agitator 6 is preferably formed by a suitably shaped propeller or blade set 36 for setting up a liquid slurry circulation resulting in good mixing in the lower portion of the vessel 4. Preferably, the shaft 26, the fan 24, the basket 28, and the propeller 36 are positioned on the longitudinal axis of the vessel 4 with the shaft 26 being positioned on the longitudinal axes of the fan 24, the basket 26 and propeller 36. The fan 24 and the basket 28 are preferably connected with the lower end of the fan 24 connected to the upper end of the basket 28 along the rim of the basket where the fan is of the squirrel-cage type. An annulus is formed between the inside wall of the vessel 4, the fan, and the basket body. The rotation of the shaft 26 assists in coalescing liquid droplets on the exterior surface of the basket 28 and protects the catalyst from the heavies in the reaction mixture.

Figure 4:
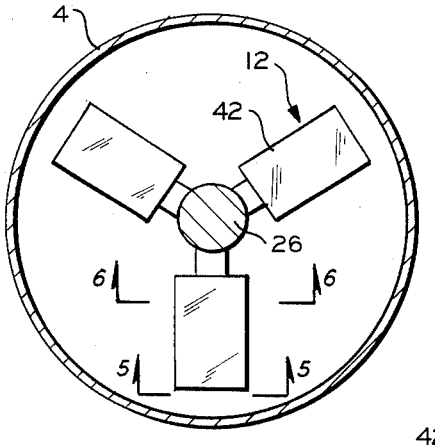
FIG. 4 schematically illustrates an alternative of a portion of the apparatus of FIG. 1 as would appear when viewed along lines 4—4.
Figure 5:
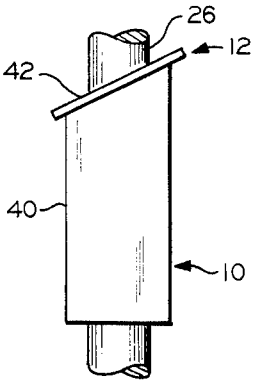
FIG. 5 is a view of a portion of the apparatus of FIG. 4 when viewed along line 5—5.
Figure 6:
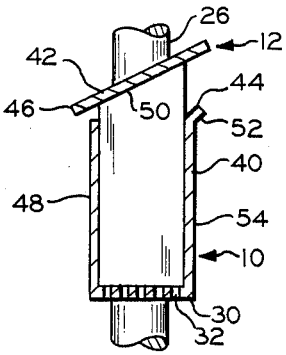
FIG. 6 is a cross-sectional view of a portion of the apparatus of FIG. 4 when viewed along line 6—6.

In FIGS. 4 through 6, the reference numeral 4 represents the vessel suitable for use with internal pressures in the range of from 300 to 3000 psig. The reference numeral 10 represents the means for supporting the catalyst bed. The numeral 12 indicates the means for causing fluid flow through the catalyst bed. The means 10 and the means 12 are mounted to the shaft 26 and the bottom end 30 of the means 10 for supporting the bed has apertures 32 therethrough to provide for drainage from the bed. The apparatus of FIGS. 4 through 6 differs from the apparatus of FIGS. 1 through 3 in that a plurality of baskets 40 extend generally radially outwardly from the shaft 26 and provide the means 10 for supporting the catalyst bed. A fan blade or paddle 42 extends generally radially outwardly from the shaft 26 in covering relationship with an upper end 44 of the basket 40. The blade 42 is slightly spaced apart from the upper end 44 of the basket 40 and, with respect to the rotation of the shaft 26, the trailing edge 46 of the blade is spaced circumferentially behind or spaced apart from the trailing edge 48 of the basket 40. Liquid which impinges on the lower surface of the blade 42 will flow to the trailing edge 46 of the blade rather than fall into the catalyst bed. A lip 52 can be provided on the leading edge 54 of the basket 40. Fluid impinging on the leading face or edge 54 of the basket 40 will be caused to flow generally radially outwardly because of the lip 52 rather than possibly entering the catalyst bed. The movement of the baskets 40 should cause coalescence of entrained mist and keep heavy organic materials with high carbon-forming tendencies apart from the catalyst bed.

The size of the catalyst beds and flow rates through the beds will be dependent upon the hydrogenation severity desired.

In operation, a generally liquid phase reaction mixture containing carbonaceous material, hydrogen and hydrogenated hydrogen-donor solvent is formed and maintained in the vessel 4. Suitable carbonaceous materials can be selected from heavy oils, asphalts, petroleum resids, tar sands, lignite and coal, for example. Generally, the carbonaceous material will be introduced into the vessel 4 via a feed line 56. The feed line preferably is provided with a pump 58 to bring the reaction mixture up to the desired pressure and a heater 60 to bring the reaction mixture up to the desired temperature. Hydrogen can be introduced into the mixture via a line 62 and can be derived in part from off-gases from the vessel 4. The line 62 will generally contain a blower 64 to bring the hydrogen up to reactor pressure. Hydrogen makeup line 66 is connected to the line 62 to supply makeup hydrogen as needed.

The conduit 62 is connected to a separator 68 which separates out a hydrogen-enriched stream from the reactor off-gases. The separation means 68 in the device illustrated in FIG. 1 is a conduit means having a cooler 70, a condenser 72 with boot 74 and an acid gas scubber 76 to remove acid gases from the hydrogen stream. A conduit 78 withdraws liquid hydrocarbons from the boot of the accumulator 72. A conduit 80 connects an upper portion of the accumulator 72 with the acid gas scrubber 76. In the acid gas scrubber 76, lean absorbent or solvent such as diethanolamine for the removal of hydrogen sulfide, carbon dioxide and other acid gas constituents is introduced into an upper end of a column 82 via a line 84 and rich amine solution containing the acid gas components is withdrawn from a lower portion of the column 76 via the line 86.

Liquids are recovered from the liquefaction reactor 4 through a line 88 connected to a lower portion of the reactor 4, passed through pressure letdown valve such as the valve 90 and heat transfer equipment such as the cooler 92 and fed to a separator such as a fractionator 94. In the fractionator 94, the liquid stream is fractionated to produce an overhead stream composed primarily of light hydrocarbon gases which is recovered through a line 96 connected to the upper end of the fractionator 94. A naphtha stream or its equivalent generally boiling up to about 420° F. is recovered through a line 98 in an upper portion of the fractionator 94. An intermediate liquid stream such as a gas oil stream or its equivalent having a boiling point in the range of between about 400° and about 1000° F. can be withdrawn via the line 100 and further processed such as in a hydrotreater 102. A heavy bottoms stream 104 can be withdrawn from the lower end of the column 94 and further processed as desired. For example, the heavy bottoms stream can be heated in a heater 106 and introduced into a vacuum fractionator 108 from which a heavy gas oil stream or its equivalent can be withdrawn overhead via the line 110 and a heavy bottoms stream 113 can be withdrawn from the lower end of the vacuum fractionator via a line 112. The stream 113 can be recycled to the reactor 4 if desired.

In FIG. 7, the reaction mixture is formed in the reactor 4. A slurry of carbonaceous material and liquid such as hydrogen donor solvent or recycle is introduced into the reactor 4 via a conduit 112. The hydrogenated hydrogen-donor solvent is introduced into the reactor 4 via the conduit 18. Hydrogen is introduced into the reactor 4 via a conduit 114. If desired, hydrogen can be added to the donor-solvent regenerators 14 by a conduit 119. The conduit 114 contains a heater 116 to heat the hydrogen to the desired temperature. Makeup hydrogen is added to the conduit 114 as required via the line 118 which connects thereto. The recycle hydrogen is brought to pressure by a blower 120 positioned in the conduit 114. The recycle hydrogen stream 114 is separated from the gaseous reactor effluent by taking a side draw stream from the conduit 16 and transporting it to a separator 122 via a conduit 124. The separator 122 can be a fractionator if desired. A cooler 128 is provided in the line 124 to bring the contents thereof to the proper temperature prior to the introduction into the fractionator 122. A normally liquid bottoms stream can be withdrawn from the fractionator 122 via a conduit 126. A hydrogen-enriched stream is withdrawn from the upper end of the fractionator 122 via the conduit 114.

The reactor 4 is preferably further provided with a reboiler means 130 to maintain reaction temperature during the endothermic upgrading reactions which occur. The reboiler 130 comprises a conduit means 132 forming a loop connecting two bottom portions of the reactor and contains a heater 134. Liquid reaction product can be withdrawn from the reactor 4 by conduit 136.

Suitable hydrogen-donor solvents in the hydrogenated form can be selected from the group consisting of indane, $C_{10}$ through $C_{12}$ tetrahydronaphthalenes, $C_{12}$ $C_{13}$ acenaphthenes, dihydroanthrecene, tetrahydroanthrecene, octrohydroanthrecene, tetrahydroacenaphthene, crysene, phenanthrene and pyrene. Tetrahydronaphthalene is preferred. The hydrogenation catalyst for converting the hydrogen-donor solvent into its hydrogenated form can be molybdenum and one of nickel and cobalt deposited on an alumina support. A typical catalyst will contain about 9 percent molybdenum and about 3 percent nickel and cobalt by weight and have a surface area of about 160 $m^2/g$ with an average pore diameter of about 100 Å. A suitable form of catalyst is ⅛-inch extrudate. Nickel-molybdenum catalyst is preferred. If necessary, the catalyst can be regenerated in air to burn off accumulated coke and/or sulfur deposits. However, where most of the worst of the coke precursors are kept apart from the catalyst it is expected that the catalyst can be used for several months without regeneration.

Preferably, the carbonaceous material is selected from the group consisting of lignite and petroleum residuum and the reaction mixture is formed from about 0.5 to about 20 pounds, preferably 1 to 5 pounds, of hydrogenated hydrogen-donor solvent for each pound of the carbonaceous material. Most preferably, the hydrogen-donor solvent will be mixed with the lignite or heavy oil in a ratio of from about 1.5 to about 4 pounds of solvent, per pound of dry lignite or heavy oil. The reaction medium is maintained at a temperature in the range of from about 400° to about 1200° F., preferably 600°–850° F., and at a pressure in the range of from about 300 to about 3000 psig, preferably 1500 to 2500 where the solvent hydrogenation and liquefaction reactions are carried out in open communication with each other, or 500–1500 psig where the solvent hydrogenation is to occur at a higher pressure, for a period of time in the range of from about 0.1 to about 10 hours. Usually, a reaction time period in the range of from about 0.2 to about 4 hours is expected to provide good results. The reaction mixture preferably comprises in the range from about 1 to about 10 weight percent, usually from about 2 to 5 weight percent hydrogen on a moisture and ash-free basis based on weight of coal. Where nickel-molybdenum catalyst is used in the donor solvent hydrogenation zone, the hydrogenation zone is usually maintained at a total pressure in the range of 1000 to about 3000 psig, preferably in the range of 1500 to 2000 psig, a hydrogen partial pressure in the range of about 1000 to about 3000 psig, preferably in the range of 1500 to 2000 psig, and a temperature in the range of about 300° to about 450° C., preferably in the range of about 350° to about 400° C. Solvent flows through the bed primarily in the vapor phase, at a 1 LHSV in the range of 5 to about 0.5 $hr^{-1}$. The invention is illustrated by the following example.

CALCULATED EXAMPLE

With reference to FIG. 7, 150 lb/hr of coal derived solvent and 100 lb/hr of dried coal are preheated to about 300° C. and charged via line 112 to the reactor 4. The mixture is maintained at 400° C. (750° F.) and 1,000 psig for 1 hr. residence in the reactor 4. A portion of the reaction gases (hydrocarbon gases and $H_2$) from 16 will pass through a separator 122 to separate $C_1$ to $C_4$ and $H_2$ from solvent vapor for recycle via the line 114. A portion of the reaction gases can go directly to the hydrotreater 14 or 14' for solvent reduction. For this, the pressure is increased to 2,000 psig by blower 20. The liquefaction reactor 4 doesn't need such high pressure and operating it at lower pressure can save on capital cost. The reduced solvent will be pumped back to the coal liquefaction reactor 4 directly via line 18.

The gaseous effluent 16 from the liquefaction reactor will contain $C_1$ to $C_4$ hydrocarbons, $CO_2$, CO (totaling about 10–30% based on coal charged), coal liquids which can be withdrawn from line 136 and contain $C_5$ up to $C_{45}$ hydrocarbons (60–80% based on coal charged) and unreacted coal and coal ashes (5–10% based on coal charged). The solvent fraction of the coal liquids withdrawn by 136 can be separated by fractionation to be used by coal slurry preparation.

TABLE I

| Stream | Identity | Temp. °C. | Pressure, Psig | Flow, |
|---|---|---|---|---|
| 112 | Coal slurry Solvent/coal (1.5/1) | 300 | 1200 | 250 lb/hr |
| 18 | Reduced process derived solvent | 400 | 2000 | 300 lb/hr |
| 114 | $H_2$ | 400 | 1200 | 64 lb/hr |
| 4 | Reaction mixture solvent/coal $H_2$ | 400 | 1100 | Residence 1 hr |
| 132 | Reaction mixture | Heated to 425 | 1100 | 550 lb/hr |
| 124 | Product gas | 400 | 1100 | 50 lb/hr |
| 126 | $C_4$–$C_{10}$ Hydrocarbon | 40 | 100 | 21 lb/hr |
| 118 | Hydrogen makeup | 40 | 1200 | 35 lb/hr |
| 14/14' | Hydrotreaters | 350 | 1800 | 300 lb/hr |
| 16 | $H_2$ and offgases solvent vapors | 350 | 1100 | 350 lb/hr |
| 136 | Product + Coal Ash | 400 | 1100 | 264 lb/hr |

I claim:

1. A process comprising (a) forming a reaction mixture of liquid phase hydrogenated hydrogen-donor solvent, hydrogen and a carbonaceous material selected from the group consisting of petroleum residuum, asphalt, tar sand, lignite and coal in a liquefaction zone;

(b) maintaining a vapor phase in said liquefaction zone containing hydrogen, dehydrogenated hydrogen-donor solvent, and upgraded liquefaction products so that said reaction mixture reaches equilibrium with said vapor phase;

(c) passing at least a portion of said vapor phase from said liquefaction zone through a separate regeneration zone maintained under conditions to form hydrogenated hdyrogen donor solvent;

(d) condensing hydrogenated hdyrogen-donor solvent produced in said regeneration zone to provide condensed hydrogenated hydrogen-donor solvent;

(e) introducing into said reaction mixture at least a portion of said condensed hydrogenated hydrogen-donor solvent and (f) withdrawing upgraded liquid product from the liquefaction zone.

2. A process as in claim 1 wherein the reaction mixture is maintained at a temperature in the range of 400° to 1200° F. and a pressure in the range of 300 to 3000 psig.

3. A process as in claim 2 wherein the regeneration zone contains a catalyst bed and the at least a portion of the vapor phase is passed through the catalyst bed for hydrogenation.

4. A process as in claim 3 wherein the hydrogenated hydrogen-donor solvent is selected from the group consisting of indane, $C_{10}$ through $C_{12}$ tetrahydronaphthalenes, $C_{12}$ and $C_{13}$ acenaphthenes, dihydroanthrecene, tetrahydroanthrecene, octrohydroanthrecene, tetrahydroacenaphthene, crysene, phenanthrene, pyrene and tetralene and the catalyst bed comprises molybdena-alumina modified with at least one of nickel and cobalt.

5. A process as in claim 4 wherein the carbonaceous material is selected from lignite and petroleum residuum and the reaction mixture contains from about 0.5 to 20 pounds of hydrogenated hydrogen-donor solvent for each pound of carbonaceous material, said process further comprising maintaining said reaction mixture at a temperature in the range of from about 400° to about 1200° F. at a pressure in the range of 300 to 3000 psig for a period of time in the range of 0.1 to about 10 hours.

6. A process as in claim 5 further comprising circulating the reaction mixture.

7. A process comprising (a) forming a reaction mixture of liquid phase hydrogenated hydrogen-donor solvent, hydrogen and a carbonaceous material selected from the group consisting of petroleum residuum, asphalt, tar sand, lignite and coal in a liquefaction zone;

(b) maintaining a vapor phase in said liquefaction zone containing hydrogen, dehydrogenated hydrogen-donor solvent, and upgraded liquefaction products so that said reaction mixture reaches equilibrium with said vapor phase;

(c) passing at least a portion of said vapor phase through a regeneration zone located in the vapor space of said liquefaction zone, said regeneration zone maintained under conditions to form hydrogenated hydrogen-donor solvent;

(d) condensing hydrogenated hydrogen-donor solvent produced in said regeneration zone to provide condensed hydrogenated hydrogen-donor solvent;

(e) introducing into the reaction mixture at least a portion of said condensed hydrogenated hydrogen-donor solvent; and (f) withdrawing upgraded liquid product from the vessel.

8. A process as in claim 7 further comprising circulating the reaction mixture and circulating said vapor from the liquefaction zone vapor phase through the catalyst bed.

9. A process as in claim 8 wherein the reaction mixture is maintained at a temperature in the range of 400° to 1200° F. and a pressure in the range of 300 to 3000 psig.

10. A process as in claim 9 wherein the regeneration zone contains a catalyst bed and the at least a portion of the vapor phase is passed through the catalyst bed for hydrogenation.

11. A process as in claim 10 wherein the hydrogenated hydrogen-donor solvent is selected from the group consisting of indane, $C_{10}$ tetrahydronaphthalenes, $C_{12}$ and $_{13}$ acenaphthenes, dihydroanthrecene, tetrahydroanthrecene, octohydroanthrecene, tetrahydroacenaphthene, crysene, phenanthrene, pyrene and tetralene and the catalyst bed comprises molybdena-alumina modified with at least one of nickel and cobalt.

12. A process as in claim 11 wherein the carbonaceous material is selected from lignite and petroleum residuum and the reaction mixture contains from about 0.5 to 20 pounds of hydrogenated hydrogen-donor solvent for each pound of carbonaceous material, said process further comprising maintaining said reaction mixture at a temperature in the range of from about 400° to about 1200° F. at a pressure in the range of 300 to 3000 psig for a period of time in the range of 0.1 to about 10 hours.

* * * * *